US011633635B2

(12) United States Patent
Rocks et al.

(10) Patent No.: US 11,633,635 B2
(45) Date of Patent: Apr. 25, 2023

(54) INFLATABLE FIRE BARRIER

(71) Applicants: Lawrence Rocks, Stony Brook, NY (US); Burton Rocks, Stony Brook, NY (US)

(72) Inventors: Lawrence Rocks, Stony Brook, NY (US); Burton Rocks, Stony Brook, NY (US)

( * ) Notice: Subject to any disclaimer, the term of this patent is extended or adjusted under 35 U.S.C. 154(b) by 198 days.

(21) Appl. No.: 17/192,624

(22) Filed: Mar. 4, 2021

(65) Prior Publication Data

US 2022/0280820 A1 Sep. 8, 2022

(51) Int. Cl.
*A62C 2/24* (2006.01)
*A62C 3/02* (2006.01)

(52) U.S. Cl.
CPC ..... *A62C 2/248* (2013.01); *A62C 3/0257* (2013.01)

(58) Field of Classification Search
CPC .. A62C 2/06; A62C 2/248; A62C 2/10; A62C 3/0257; A62C 3/0221; A62C 3/02; A62C 8/06; E21F 17/107
USPC ..... 169/48, 45, 64, 46
See application file for complete search history.

(56) References Cited

U.S. PATENT DOCUMENTS 3,635,290 A * 1/1972 Schneider ..... A62C 3/0257 169/48
4,311,199 A * 1/1982 Elias ..... A62B 3/00 256/65.01
4,332,049 A * 6/1982 Fisher ..... A62B 1/20 182/47
6,918,447 B2 * 7/2005 Robinson, Jr. ..... E06B 9/0692 169/48
7,866,101 B2 * 1/2011 Boggs, Jr. ..... A62C 2/06 52/2.25
7,963,075 B2 * 6/2011 Howland ..... A62C 3/0257 160/40
8,146,298 B2 * 4/2012 Bush ..... B32B 5/22 428/116
9,381,387 B2 * 7/2016 Douglas ..... A62C 3/0264
2006/0277830 A1 * 12/2006 Boggs ..... A62C 2/06 52/2.22
2010/0025054 A1 * 2/2010 Jesclard ..... A62C 3/065 29/428
2010/0294520 A1 11/2010 Aguirre
2010/0300707 A1 * 12/2010 Kolios ..... A62C 3/0257 169/48
2019/0060684 A1 * 2/2019 West ..... A62C 2/10
2020/0238113 A1 * 7/2020 Glaser ..... A62C 3/0257

FOREIGN PATENT DOCUMENTS

WO WO-2012065042 A1 * 5/2012 ..... A62C 2/10

* cited by examiner

*Primary Examiner* — Qingzhang Zhou
*Assistant Examiner* — Kevin Edward Schwartz
(74) *Attorney, Agent, or Firm* — Lucas & Mercanti, LLP

(57) ABSTRACT

A fire barrier includes an inflatable base deployable from an empty state to a fully inflated state and a first row of panels including a plurality of first panels disposed on the inflatable base. The base supports the plurality of first panels in an upright state when the inflatable base is in the fully inflated state, thereby forming a wall having a front side and a rear side opposing the front side. Each of the plurality of panels is independently elastically bendable with respect to the inflatable base. A coating of an infrared reflective material is disposed on each of the plurality of panels on the front side of the wall.

15 Claims, 4 Drawing Sheets

INFLATABLE FIRE BARRIER

BACKGROUND OF THE INVENTION

The present invention relates to a fire barrier to prevent infrared light from propagating from a forest fire to neighboring trees or houses.

Infrared heating (also referred to as "IR heating" herein) is the cause of the rapid and explosive spread of forest fires. A large percentage of energy released when wood burns appears as infrared radiation. For example, the infrared energy in a candle flame can be as high as 25% of the total energy released in combustion of the candle. In a forest fire, infrared energy that is emitted laterally, i.e., ground-parallel infrared radiation, heats nearby objects such as neighboring trees or houses. This leads to evaporation of moisture in the surrounding objects and can release flammable gases through a process called pyrolysis. Further, heat transfer from a wildfire can heat surrounding air to 1470° F., drying all flammable matter in the immediate vicinity and encouraging the fire to spread much faster.

U.S. Pat. No. 4,311,199 discloses a reusable portable firewall having a plurality of modular panels made of aluminum.

US 2010/0294520 discloses a fire shield system in the form of a fence that can be deployed between a fire and neighboring trees, houses, and other buildings. The fence is made of the fabric capable of withstanding high temperatures such as, for example, an aramid fiber. The fence is supported by a flexible support frame including tubular members that can be inflated.

However, the prior art shield systems have a problem in that a strong gust of wind could knock down the panels rendering them ineffective.

SUMMARY OF THE INVENTION

An object of the invention is to provide an improved fire barrier that reflects ground-parallel IR radiation back towards the fire, is easily deployable, easily transportable, and withstands wind gusts.

The present invention provides a plurality of panels with infrared reflectors that form a wall that reduces a forest fire's ground-parallel IR heating radiation that heats trees and homes in the forest fire's path of advance. The decrease in infrared heating results in a cooling effect that slows or stops the fire's explosive advance. Each of the panels is individually elastically bendable when exposed to a gust of wind and resumes its upright position after the wind gust has passed.

The fire barrier of the present invention can provide an infrared shading effect to firefighters, thereby lessening their needs for personal protective equipment which guard against infrared radiation exposure.

The use of the fire barrier of the present invention may also reduce the need for helicopter use to drop water or chemicals in a forest fire. By keeping the trees and homes cooler with the fire barrier of the present invention, no back burning fires need to be ignited.

The object of the present invention is met by a fire barrier that includes an inflatable base deployable from an empty state to a fully inflated state and a first row of panels including a plurality of first panels disposed on the inflatable base. The base supports the plurality of first panels in an upright state when the inflatable base is in the fully inflated state, thereby forming a wall having a first side and a second side opposing the first side. Each of the plurality of panels is independently elastically bendable with respect to the inflatable base. A coating of an infrared reflective material disposed on each of the plurality of first panels on the first side of the wall.

In one embodiment, the plurality of panels is arranged so that there are gaps between the successive pairs of the plurality of panels in the first row. The gaps form less than 5% of the area of the first side of the wall. In a specific embodiment, each of the panels is up to four feet wide and the gap between successive panels is 1-2 inches.

Each of the plurality of panels is inflatable with the inflatable base. The inflatable base and the plurality of panels are made of plastic.

The infrared reflective material includes aluminum oxide.

The inflatable base includes anchor tabs having holes for receiving stakes for holding the inflatable base on the ground. In a specific embodiment, the stakes may be connected to the anchor tabs obviating the need to separately carry the stakes.

In a further embodiment of the present invention, a second row including a second plurality of panels facing a second side of the wall formed by the first row, each panel of the second plurality of panels being arranged behind a respective one of the gaps in the first row. Each of the plurality of second panels includes a coating of the infrared reflective material facing the first side of the wall.

In yet a further embodiment, each of the plurality of first panels has a substantially uniform thickness. Alternatively, at least one of the plurality of first panels has a thickness that tapers toward a top of the first panels.

The base has a substantially flat bottom in the inflated state to provide stability. At least one side of the at least one of the plurality of first panels is perpendicular to the flat bottom of the base in the inflated state.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PREFERRED EMBODIMENTS

Figure 1:
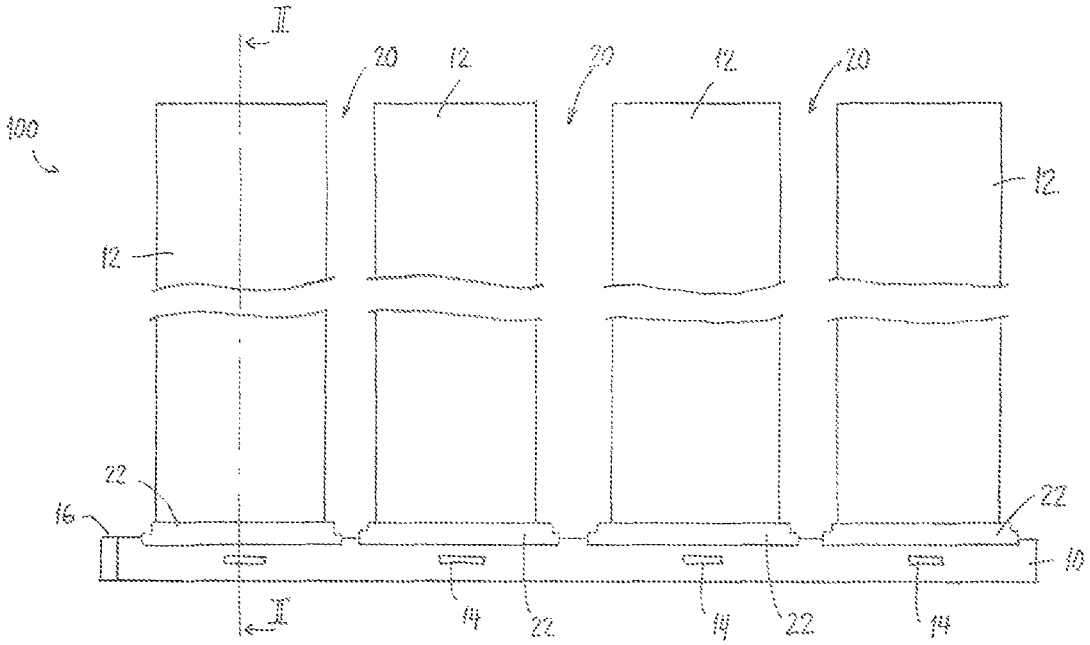
FIG. 1 is a front view of a fire barrier according to an embodiment of the present invention.
Figure 2:
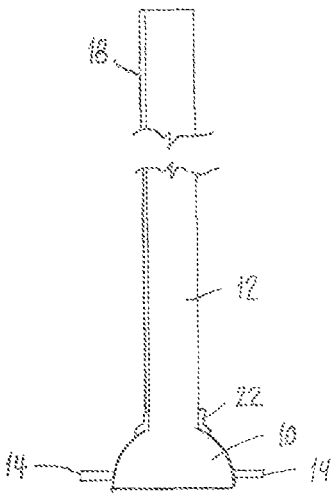
FIG. 2 is a sectional view of the fire barrier of FIG. 1 along line II-II.

A first embodiment of the fire barrier 100 is disclosed in FIGS. 1 and 2. The fire barrier includes a base 10 and four panels 12. The base 10 is in the form of an air hose having a connector 16 at one end for connection to an air pump (not shown). The fire barrier 100 is shown in the inflated state in FIGS. 1 and 2, in which the panels 12 extend upward from the base to a height of at least 10 feet, and preferably at least 20 feet. In the inflated state, the fire barrier forms a wall having a front side intended to face the fire and a rear side opposing the from side. Each of the panels 12 is 4 feet wide and is separated from an adjacent one of the panels 12 by a gap 20 of approximately 1-2 inches. The gaps 20 form less that 5% of the area of the front side of the wall.

The gaps 20 allow wind to pass through the fire barrier 100. Further, each of the panels 12 is elastically flexible relative to the base 10, so that if a strong gust of wind passes the fire barrier 100, the panels 12 will momentarily bend to let the wind pass and then will resume their upright position to continue to provide protection. The panels 12 are connected to each other only through the base 10 and thereby move individually in erratic winds. The base 10 includes anchor tabs 14 that can be staked and hold the fire barrier onto the ground below the fire barrier 100.

In the embodiment shown in FIGS. 1 and 2, a support collar 22 is disposed at a bottom of the panel 12 and extends to the base 10. More specifically, the support collar 22 surrounds the bottom of the panel 12 where the panel 12 meets the base 10 to strengthen the joint between the base 10 and each panel 12. The support collar 22 may simply comprise a thicker piece of the same material as the base 10 and the panel 12. Alternatively, the support collar 22 may include a stronger material than the material of the base 10 and the panel 12 such as, for example, a stiffer plastic material.

Each of the panels 12 is coated with a layer 18 of an infrared reflecting material. In the preferred embodiment, the layer 18 includes aluminum oxide. However, any other known or hereafter developed infrared reflecting material may alternatively be used in the layer 18.

Figure 3:
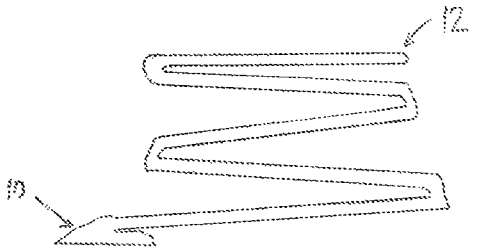
FIG. 3 is a side view showing folding of one of the panels of the fire barrier of FIG. 1.
Figure 4:
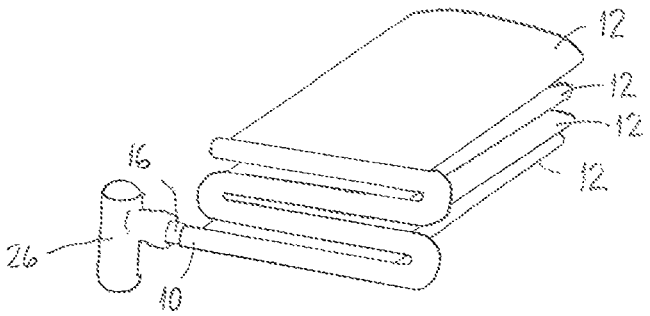
FIG. 4 is a perspective view of the fire barrier of FIG. 1 in the folded state.

The front side of each individual panel 12 of the fire barrier 100 can be folded as shown in FIG. 3. As shown in FIG. 4, the folded panels 12 can be folded one on top of the other so that the fire barrier 100 can be stacked with other fire barriers 100 in a compact volume. A small pneumatic pump 26 may be used at the point of deployment to inflate the barrier 100. The pneumatic pump 26 may be a separate standalone pump as depicted in FIG. 4. Alternatively, the pneumatic pump 26 may be incorporated in the vehicle used to transport the fire barrier 100. From the point of deployment, the fire barrier 100 is easily moved wherever fire protection is needed due to its light weight.

Figure 5:
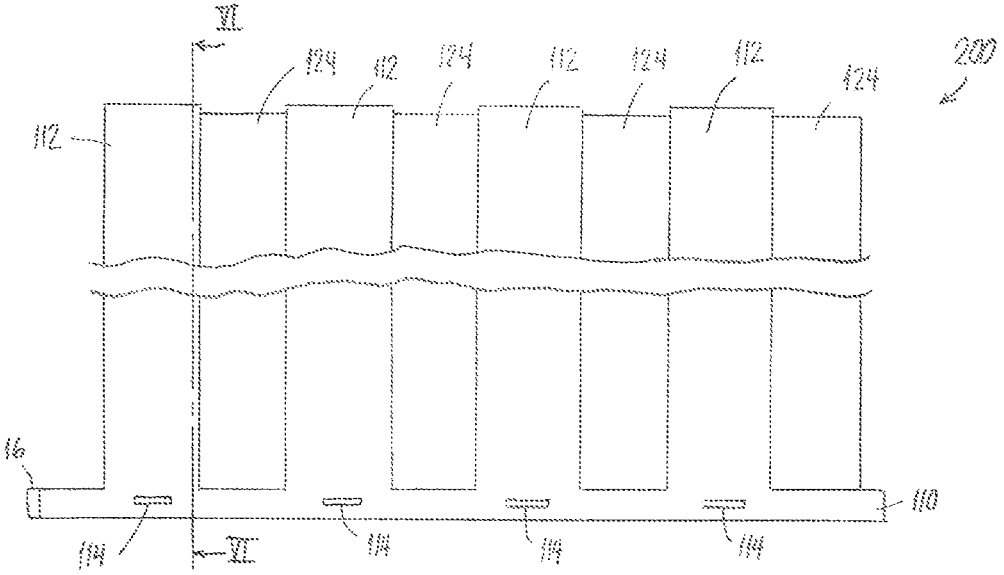
FIG. 5 is a front view of a fire barrier according to another embodiment of the present invention.
Figure 6:
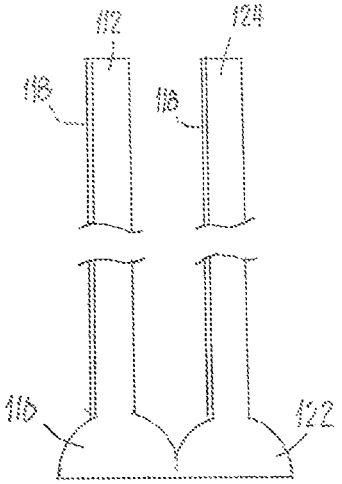
FIG. 6 is a sectional view of the fire barrier of FIG. 5 along line VI-VI.

In a further embodiment shown in FIGS. 5 and 6, a fire barrier 200 includes a first row of first panels 112 and a second row of second panels 124, behind the first panels 112. In this embodiment, the gaps or spaces between the first panels 112 is bigger than in the first embodiment. The second panels 124 are arranged to cover the space behind the gaps between the first panels 112. Both the first panel 112 and the second panels 124 have a layer 118 of infrared reflecting material. Accordingly, the entire area of the fire barrier 200 reflects infrared back towards the fire. The gaps between first panels 112 and the gaps between the second panels 124 allow wind to pass through the fire barrier 200. As in the previous embodiment, each of the panels 112, 124 is elastically flexible relative to the base to momentarily bend when exposed to the wind.

In the embodiment of FIGS. 5 and 6, the base 110 is in the form of two air hoses connected side by side. These air hoses are connected at the end of the base 110 having the connector 16. Alternatively, base could include one air hose to which both rows of panels 112, 124 are connected.

Figure 7:
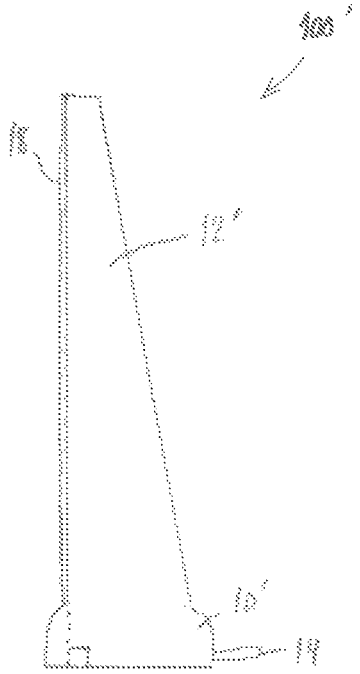
FIG. 7 is a side view of a further embodiment of the present invention.

In the embodiments of FIGS. 1-6, the panels 12, 112, and 124 have a substantially uniform thickness throughout the entire height. In a further embodiment shown in FIG. 7, each panel 12' of the fire barrier 100' has a thickness that increases toward the base 10', i.e., tapers toward a top of the panel 12'. This embodiment provides increased stability, but uses more air for inflation. In the embodiment of FIG. 7, the front side of the panel 12' with the layer 18 of infrared reflecting material is perpendicular to a bottom layer of the base 10' so that the layer 18 is substantially vertical when the base is placed on level ground. Alternatively, it is possible for front side and the rear side of the panel 12' to be arranged at the same angle with respect to the bottom layer of the base 10'.

Thus, while there has been shown and described and pointed out the fundamental novel features of the invention is applied to a preferred embodiment thereof, it will be understood that various omissions and substitutions and changes in the form and details of the devices illustrated, and in their operation, may be made by those skilled in the art without departing from the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A fire barrier, comprising:

an inflatable base in the form of an air hose deployable from an empty state to a fully inflated state and having a length in the fully inflated state;

a first row of panels including a plurality of first panels disposed on the inflatable base and extending along the length of the inflatable base, the inflatable base supporting the plurality of first panels in an upright state when the inflatable base is in the fully inflated state, the plurality of first panels forming a wall having a front side and a rear side opposing the front side in the fully inflated state, each panel of the plurality of panels being independently elastically bendable with respect to the inflatable base in the fully inflated state;

a coating of an infrared reflective material disposed on each panel of the plurality of panels on the front side of the wall; and a plurality of collars, each collar of the plurality of collars surrounding a bottom of a respective panel of the plurality of panels and connecting a bottom of the respective panel of the plurality of panels to a top of the inflatable base.

2. The fire barrier of claim 1, wherein each panel of the plurality of first panels is separated from an adjacent panel of the plurality of first panels in the first row by a gap in the fully inflated state.

3. The fire barrier of claim 2, wherein the gaps form less than 5% of the area of the front side of the wall.

4. The fire barrier of claim 1, wherein each panel of the plurality of first panels is inflatable with the inflatable base.

5. The fire barrier of claim 1, wherein the inflatable base and the plurality of first panels are made of plastic.

6. The fire barrier of claim 1, wherein the infrared reflective material includes aluminum oxide.

7. The fire barrier of claim 1, wherein the inflatable base includes anchor tabs having holes for receiving stakes for holding the inflatable base on a ground surface.

8. The fire barrier of claim 2, further comprising a second row including a second plurality of panels facing a second side of the wall formed by the first row, each panel of the second plurality of panels being arranged behind a respective one of the gaps in the first row.

9. The fire barrier of claim 8, wherein each panel of the plurality of second panels includes a coating of the infrared reflective material facing the front side of the wall.

10. The fire barrier of claim 1, wherein each panel of the plurality of first panels has a substantially uniform thickness.

11. The fire barrier of claim 1, wherein at least one panel of the plurality of first panels has a thickness that tapers toward a top of the plurality of first panels.

12. The fire barrier of claim 11, wherein the inflatable base has a substantially flat bottom in the inflated state.

13. The fire barrier of claim 12, wherein at least one side of the at least one panel of the plurality of first panels is perpendicular to the substantially flat bottom of the base in the fully inflated state.

14. The fire barrier of claim 1, wherein the inflatable base has a substantially flat bottom in the inflated state.

15. The fire barrier of claim 1, wherein each respective panel of the plurality of first panels is independently connected to the inflatable base through each collar and is separated from the other panels of the plurality of first panels.

* * * * *